US006929537B2

(12) United States Patent
Kajimoto

(10) Patent No.: US 6,929,537 B2
(45) Date of Patent: Aug. 16, 2005

(54) SLURRY RECYCLING METHOD

(75) Inventor: Kimihiko Kajimoto, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/428,765

(22) Filed: May 5, 2003

(65) Prior Publication Data

US 2003/0220055 A1 Nov. 27, 2003

(30) Foreign Application Priority Data

May 24, 2002 (JP) ..... 2002-151208

(51) Int. Cl.[7] ..... B24B 1/00

(52) U.S. Cl. ..... 451/60; 451/87; 451/88; 451/446

(58) Field of Search ..... 451/60, 87, 88, 451/446; 125/16.01, 16.02; 494/53, 54; 210/166, 195.1, 195.3

(56) References Cited

U.S. PATENT DOCUMENTS 5,799,643 A * 9/1998 Miyata et al. ..... 125/21
6,322,710 B1 * 11/2001 Katsumata et al. ..... 210/740
6,615,817 B2 * 9/2003 Horio ..... 125/16.01
6,743,078 B2 * 6/2004 McClain et al. ..... 451/41

FOREIGN PATENT DOCUMENTS

| | | |
|---|---|---|
| JP | 11-156719 | 6/1999 |
| JP | 11-172237 | 6/1999 |
| JP | 2001-277115 | 10/2001 |
| JP | 2001-310260 | 11/2001 |
| JP | 2001-322066 | 11/2001 |

* cited by examiner

*Primary Examiner*—George Nguyen
(74) *Attorney, Agent, or Firm*—Nixon & Vanderhye P.C.

(57) ABSTRACT

A slurry recycling method comprising the steps of: separating a spent slurry containing silicon dust resulting from slicing of a silicon ingot in the presence of a slurry composed of abrasive grains and a dispersion medium in which the abrasive grains are dispersed, into a dispersion mainly containing the abrasive grains and a dispersion mainly containing the silicon dust; recovering the dispersion medium by centrifuging and/or distilling the dispersion mainly containing the silicon dust; and reproducing a slurry using abrasive grains or the dispersion mainly containing abrasive grains, and the recovered dispersion medium.

12 Claims, 7 Drawing Sheets

SLURRY RECYCLING METHOD

CROSS-REFERENCE TO RELATED APPLICATION

This application is related to Japanese application No. 2002-151208 filed on May 24, 2002, whose priority is claimed under 35 USC § 119, the disclosure of which is incorporated by reference in its entirety.

BACKGROUND OF THE INVENTION

1. Field of the Invention

The present invention relates to a slurry recycling method. More specifically, the present invention relates to a slurry recycling method for recovering a dispersion medium and abrasive grains for recycle use from a spent slurry which is generated when brittle materials such as, for example, polycrystalline silicon for solar battery, semiconductor materials, magnetic materials and ceramics are sliced by means of a multi-wire saw (hereinafter, abbreviated as "MWS") using a slurry in which abrasive grains are dispersed in a dispersion medium.

2. Description of the Background Art

Generally, a conventional method for recovering a dispersion medium and abrasive grains from a spent slurry separates and recovers a dispersion medium and abrasive grains by using a centrifugal separator as is disclosed in Japanese Unexamined Patent Publication HEI 11(1999)-156719. In this conventional art, a recycled slurry is produced from a spent slurry in the following manner.

First a spent slurry is centrifuged by a centrifugal separator (primary) at super low G in the range of 200 to 1200 G (this process is generally called as "primary separation") to be separated into a high density liquid mainly containing abrasive grains and a low density liquid mainly containing silicon dust. The high density liquid mainly containing abrasive grains is generally called as an abrasive grain recovery liquid or a primary recovery liquid. The low density liquid mainly containing silicon dust is then applied to a centrifugal separator (secondary) at 2000 to 3500 G (this process is generally called as "secondary separation") to be separated into a solid (commonly called as "sludge") composed of dust and abrasive grains (not having recovered in the primary separation or having grained) and a dispersion medium. Thereafter, the high density liquid mainly containing abrasive grains obtained in the first centrifugation and the dispersion medium obtained in the second centrifugation are mixed with each other, and additionally fresh abrasive grains and a fresh dispersion medium are mixed thereto based on the specific gravity and viscosity, to produce a recycled slurry. This recycled slurry can be used again for the MWS.

According to the method as described above, when the amount of silicon dust in the spent slurry is 5% by weight or less, a slurry for slicing wafers can be produced again accompanied with little medium to be disposed. However, when the amount of silicon dust in the spent slurry is 5% by weight or more, the cutting performance of abrasive grains is impaired so that defects such as unevenness in thickness (TTV), warping and breakage frequently occur in wafers after slicing to deteriorate the yield. Additionally, not only breaking occurs in the slicing wire to render the yield 0%, but also the main unit of the multi-wire saw also suffers critical damage (for example, breakage of wire guide) to lead deterioration of availability.

Furthermore, in the case where a certain amount of slurry is used with being pooled in a tank until slicing of wafers completes using a water-soluble or aqueous dispersion medium, or a small amount of slurry is used with being circulated, the amount of silicon dust may become 12% by weight or more during slicing. In such a case, the viscosity of the slurry increases. Due to the increased viscosity the slurry may reside between wafers so that the wafers spread in skirt forms (peach forms), to hinder drawing wire. Or if the drawing is possible, the wire breaks the wafers so that the yield may deteriorate. Also solid substances may adhere on the surface of the wafers and further labor and time may be required for cleaning the adhered substances.

The similar problems occur also in the case where an oily dispersion medium is used and 15% by weight or more of silicon dust is contained in a slurry during slicing.

In order to prevent such problems, from several % to as large as about 70% of recycled dispersion medium obtained in the secondary separation is disposed.

Additionally, in the case where the slurry is not recycled as described above, a certain amount of or the entire spent slurry is drawn out from the tank after completion of slicing and disposed. Then a dispersion composed of fresh abrasive grains and a fresh dispersion medium is mixed in the tank for use. The amounts of the fresh abrasive grains and the fresh dispersion medium are determined while checking the degree of occurrences of warping, TTV, breakings of wafers, as well as the accuracy as is in the case where a slurry recycling apparatus is used. In general, a half or one-third of tank capacity of the spent slurry is disposed, and the corresponding amount of dispersion wherein fresh abrasive grains and a fresh dispersion medium are mixed is mixed thereto so as to produce a new slurry.

Regardless of recycling or not recycling the slurry, the expensive abrasive grains and dispersion medium need to be disposed. Furthermore, since such waste is disposed as industrial waste, the cost for such waste also increases the value of wafers obtainable by slicing.

SUMMARY OF THE INVENTION

According to the present invention, there is provided a slurry recycling method comprising the steps of:

separating a spent slurry containing silicon dust resulting from slicing of a silicon ingot in the presence of a slurry composed of abrasive grains and a dispersion medium in which the abrasive grains are dispersed, into a dispersion mainly containing the abrasive grains and a dispersion mainly containing the silicon dust;

recovering the dispersion medium by any one of methods:

(1) centrifuging the dispersion mainly containing the silicon dust by a centrifugal force of 5000 G or more;

(2) centrifuging the dispersion mainly containing the silicon dust by a centrifugal force of low G, then by centrifuging by a centrifugal force of higher G;

(3) centrifuging and distilling the dispersion mainly containing the silicon dust; and (4) distilling the dispersion mainly containing the silicon dust; and and reproducing a slurry using abrasive grains or the dispersion mainly containing abrasive grains, and the recovered dispersion medium.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
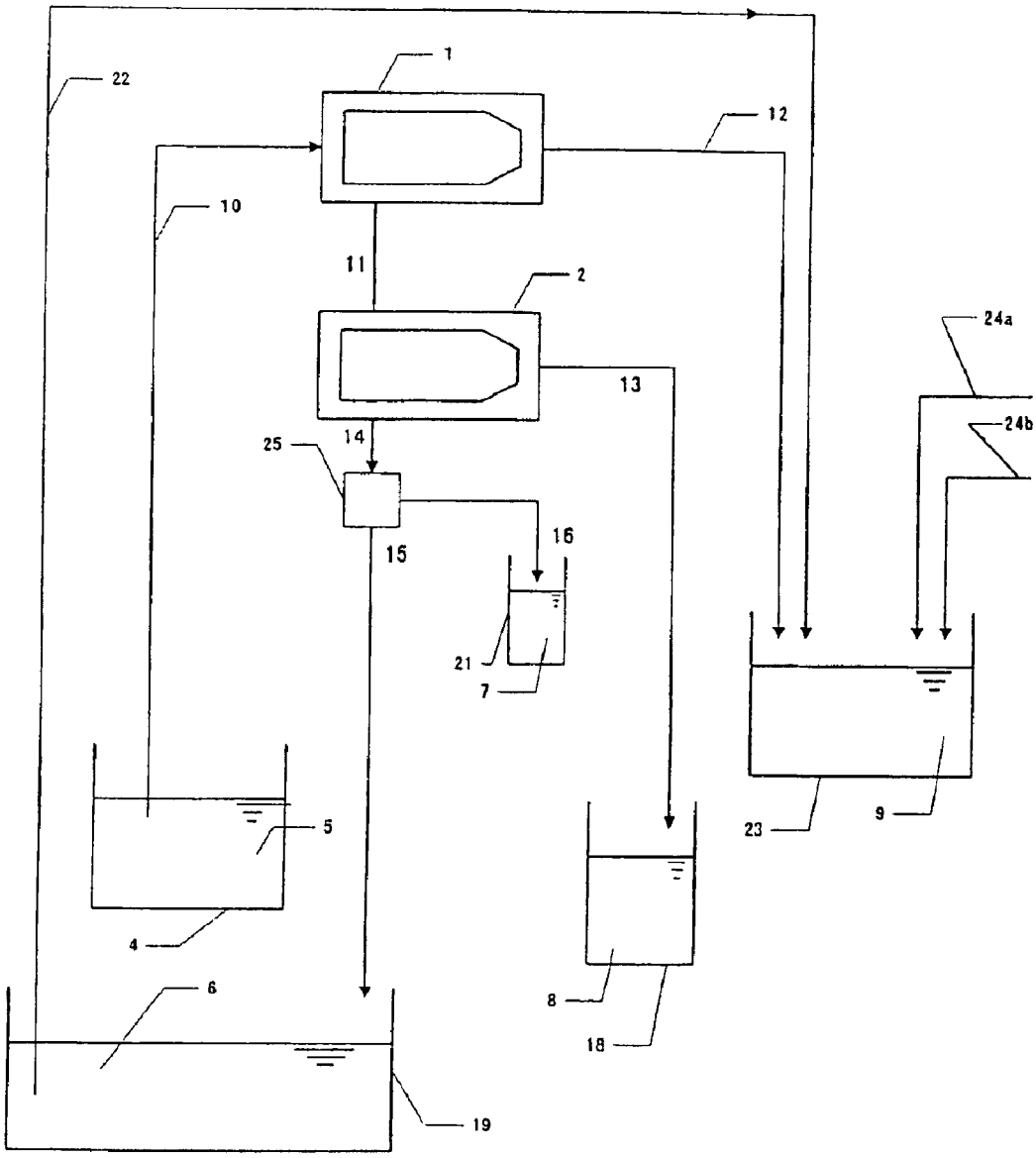
FIG. 1 is a schematic view of an apparatus which can be used for the slurry recycling method of the present invention.

First, a slurry recycled by the present invention includes at least abrasive grains and a dispersion medium. As the abrasive grains and the dispersion medium, any of those available in the art can be used. Concrete examples of the dispersion medium include water, aqueous organic solvents and their mixtures, oily organic solvents (such as mineral oils). Components other than the abrasive grains and the dispersion medium, such as a small amount of inorganic substance or the like may be contained. The abrasive grains each have a particle size of 18 to 22 $\mu$m, for example, and may be contained in a ratio of 30 to 70% by weight in the dispersion medium.

The slurry is used in producing silicon wafers by slicing a silicon ingot. Examples of the slicing method include, but not limited to, cutting the silicon ingot using cutting means such as peripheral cutting edge, inner peripheral cutting edge and wire saw while allowing the slurry to pass thorough the cutting region.

A spent slurry resulting from the above slicing may contain abrasive grains and dispersion medium in addition to silicon dust and crushed matters of the abrasive grains. The present invention is directed to a method for recycling the spent slurry. Herein the effect of the present invention that the waste can be reduced is further improved if the silicon dust is contained in a ratio of 12% by weight or more. The upper limit of the content of the silicon dust in the spent slurry is preferably 25% by weight.

The recycling method of the present invention comprises the steps of: separating the spent slurry into a dispersion mainly containing abrasive grains and a dispersion mainly containing silicon dust; recovering a dispersion medium from the dispersion mainly containing silicon dust; and reproducing a slurry using abrasive grains or the dispersion mainly containing abrasive grains, and the recovered dispersion medium.

First, the spent slurry is separated into a dispersion mainly containing abrasive grains and a dispersion mainly containing silicon dust by a known method such as precipitation or centrifugation, but the method of separating the spent slurry is not limited thereto. Especially preferred is centrifugation at a super low G in the range of 200 to 1200 G.

Next, the dispersion mainly containing silicon dust is subjected to any one of the following methods so as to recover the dispersion medium:

(1) centrifuging by a centrifugal force of 5000 G or more;

(2) centrifuging by a centrifugal force of low G, then by centrifuging by a centrifugal force of higher G;

(3) centrifuging and distilling; and (4) distilling.

According to the method (1), since the amount of silicon dust remaining in the recovered dispersion medium can be reduced compared to the conventional method, the amount of waste can be further reduced. The centrifugal force is more preferably in the range of 5000 to 20000 G.

According to the method (2), since centrifugation for recovering the dispersion medium is conducted in two steps, the dispersion medium can be recovered more efficiently. In particular, when the centrifugal force of low G is in the range of 2000 to 4000 G, and the centrifugal force of high G is 5000 G or more, it is possible to recover the dispersion medium more efficiently than the method (1). The centrifugal force of high G is more preferably in the range of 5000 to 20000 G.

According to the method (3), by combining centrifugation and distillation, it is possible to recover the dispersion medium with higher purity and in shorter time. In this method, the centrifugal force is preferably 2000 G or more, and more preferably in the range of 5000 to 20000 G. As the distillation method, any known methods can be used without any limitation.

According to the method (4), it is possible to recover the dispersion medium with higher purity. As the distillation method, any known methods can be used without any limitation.

Using the dispersion mainly containing abrasive grains and the recovered dispersion medium obtained above method, a slurry is reproduced. More specifically, if a mixture of the dispersion mainly containing abrasive grains and the recovered dispersion medium satisfies the properties as a slurry, this may be directly used as a slurry, and abrasive grains and a dispersion medium may be newly added thereto as necessary.

EXAMPLES

The present invention will now be explained in more details by way of examples, however, it is to be noted that the present invention is not limited to these examples.

Example 1

In production of solar batteries, MWS is used mainly aiming at production capacity. For example, four silicon ingots (125W×125D×400L) can be processed at once by a single slicing operation by MWS to yield about 320 wafers (125W×125D×0.3L).

The tank for accommodating the slurry used in this process has a capacity of about 200 L. In the tank, abrasive grains (specific gravity: 3.21) and a dispersion medium (specific gravity: 1, mainly composed of water and water-soluble organic solvent) are mixed in a weight ratio of 1:1, and the resulting mixture is used as a slurry. During the slicing process, about 20 kg of solids such as silicon dust will get mixed into the slurry per one slicing operation.

When this spent slurry is recycled by a slurry recycling apparatus as described in the part of conventional art, about 12% of silicon dust remains in the spent slurry. Actually about 50% to 70% of the secondary separation liquid is disposed in order to reduce the remaining silicon dust. As a result of this, silicon dust of about 6% in concentration still remains in the recycled slurry. Nevertheless the removal percentages of silicon dust is no more than about 50%.

To the contrary, the present invention is devised focusing on reduction of waste of secondary separation liquid. The present invention will now be explained with the use of FIG. 1. FIG. 1 shows a structure of an apparatus which can be used for the slurry recycling method of the present invention.

First, a spent slurry 5 within a spent slurry recovery tank 4 is introduced into a primary centrifugal separator 1 through a piping 10, and the primary centrifugal separator 1 is operated at a centrifugal force of 600 G which is a super low G (generally called as "primary separation") to separate the spent slurry 5 into a dispersion mainly containing abrasive grains (high density liquid) and a primary dispersion mainly containing silicon dust (low density liquid). The primary dispersion mainly containing silicon dust is then applied to a secondary centrifugal separator 2 at 5000 G (generally called ad "secondary separation) through a piping 11 to be separated into a sludge 8 composed of silicon dust and abrasive grains or finely grained abrasive grains that have not been recovered in the primary centrifugation and a dispersion medium. Next, the dispersion medium is transferred into a separator 25 via a piping 14 and the separator 25 gets rid of an unwanted waste liquid 7 to obtain a recovered dispersion medium 6. The recovered dispersion medium 6 is then transferred into a recovered dispersion medium tank 19 via a piping 15.

The dispersion mainly containing abrasive grains and the recovered dispersion medium 6 obtained by two centrifugations are then mixed in a recycled slurry tank 23 via a piping 12 and a piping 22, respectively. Further, fresh abrasive grains 24*a* and a fresh dispersion medium 24*b* are mixed thereto on the basis of the specific gravity, viscosity and the like, to produce a recycled slurry 9. This recycled slurry can be used for MWS. In the drawing, the reference numerals 13 and 16 each denote a piping, the reference numeral 18 denotes a sludge tank, and the reference numeral 21 denotes a waste liquid tank.

Figure 2:
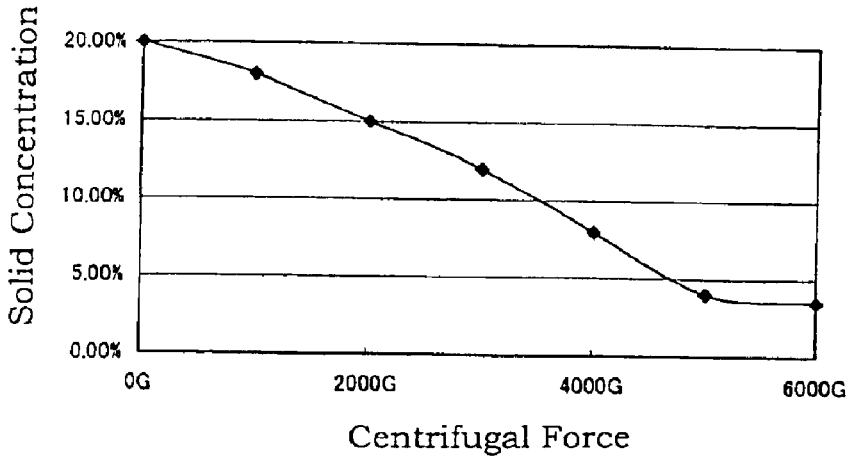
FIGS. 2(*a*) and (*b*) are graph showing the relationship between a centrifugal force and a solid concentration.
Figure 2:
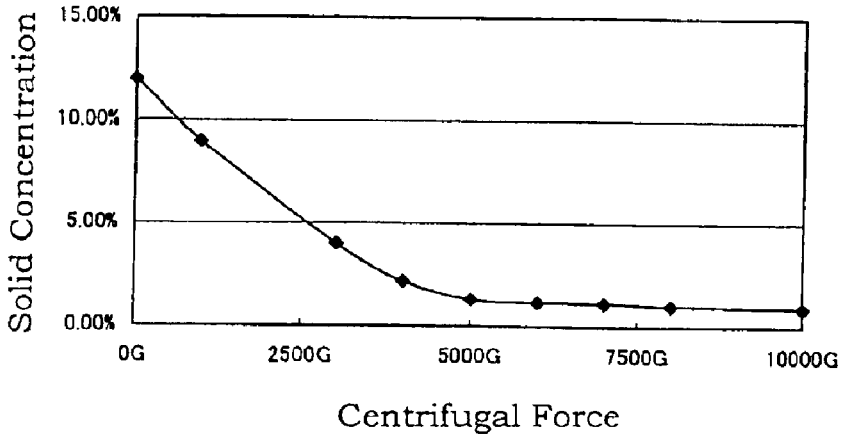

As shown in FIG. 2(*a*), the spent slurry contains about 20% by weight of a solid (silicon dust, abrasive grains not recovered and so on), and the solid content in the recovered dispersion medium 6 can be reduced to 4% by weight or less by the centrifugation of 5000 G. Accordingly, even if silicon dust remains in a concentration of about 8%, the amount of waste liquid to be disposed can be reduced to 25% (conventionally 70%).

Although the above example was made for the case where the dispersion mainly containing abrasive grains and the recovered dispersion medium 6 are mixed to reproduce a slurry, of course, a slurry may be recycled by mixing fresh abrasive grains and the recovered dispersion medium.

Example 2

Figure 3:
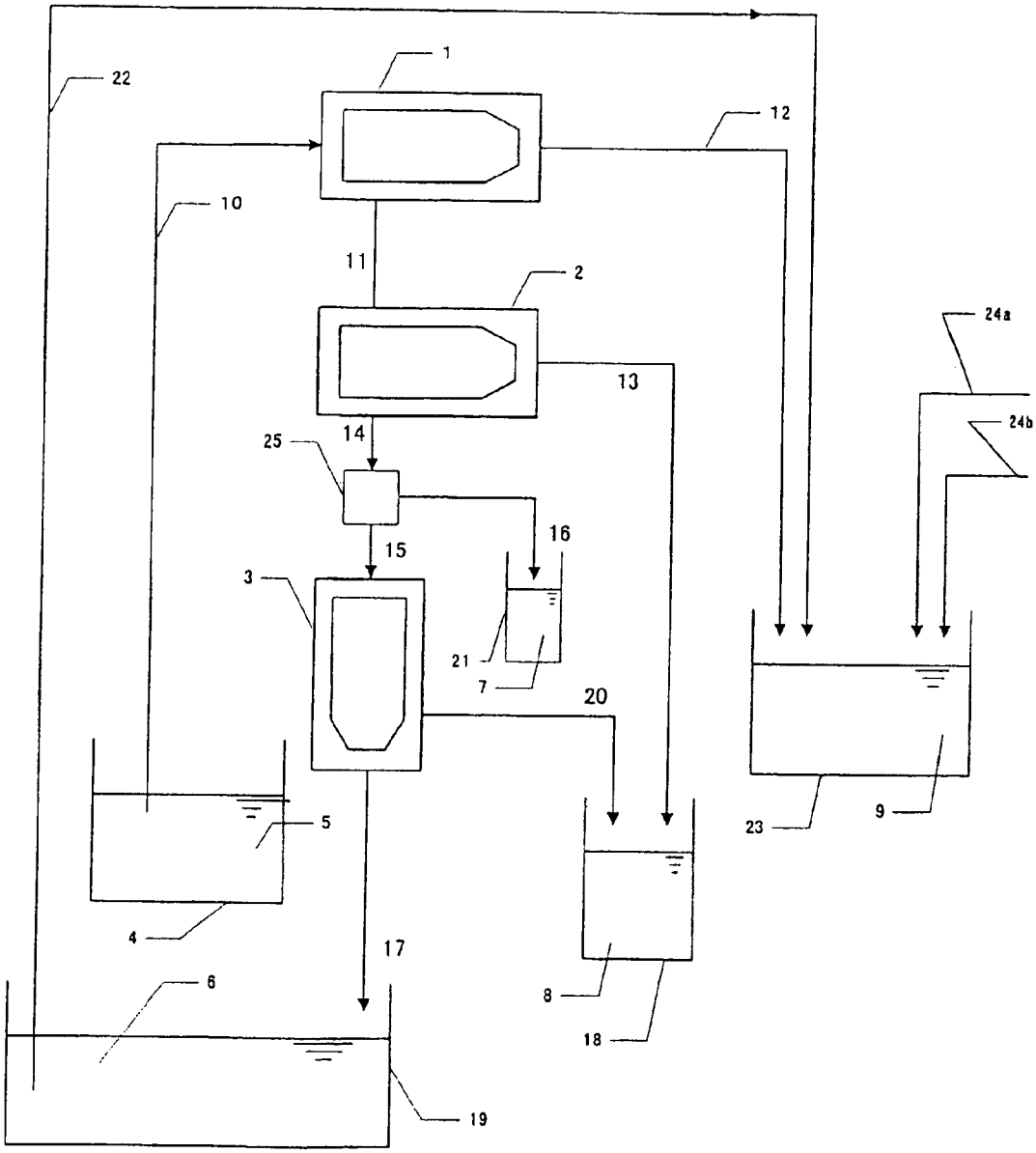
FIG. 3 is a schematic view of an apparatus which can be used for a slurry recycling method of the present invention.

Another example of the present invention will now be explained with reference to FIG. 3. FIG. 3 shows a structure of an apparatus which can be used for a slurry recycling method of the present invention.

A slurry wherein abrasive grains are dispersed in a dispersion medium is supplied to a group of MWS wires and a silicon ingot is sliced. In recycling a spent slurry which comprises at least silicon dust, abrasive grains and dispersion medium after slicing, secondary centrifugation at a centrifugal force of low G is executed followed by tertiary centrifugation at a centrifugal force of higher G, whereby the removing performance of solid is increased and the recycled slurry can be produced in shorter time.

More specific explanation will now be made. A spent slurry 5 is introduced into a primary centrifugal separator 1 using a piping 10, and by operating the primary centrifugal separator 1 at a centrifugal force of 600 G which is super low G (generally called as "primary separation"), the slurry 5 is separated into a dispersion mainly containing abrasive grains (high density liquid) and a primary dispersion mainly containing silicon dust (low density liquid). Then the primary dispersion mainly containing silicon dust is applied to a secondary centrifugal separator 2 at 3500 G (generally called as "secondary separation") using a piping 11 to be separated into a sludge 8 composed of silicon dust, abrasive grains that have not been recovered in the primary separation, finely grained abrasive grains and the like, and a dispersion medium. Next, the separator 25 gets rid of an unwanted waste liquid 7.

The resultant dispersion medium is then applied to a tertiary centrifugal separator 3 at high G (5000 G) so as to further remove the solid, thereby obtaining a recovered dispersion medium 6. Then the dispersion mainly containing abrasive grains and the recovered dispersion medium 6 obtained by three-times centrifugations are mixed. Further, fresh abrasive grains 24*a* and a fresh dispersion medium 24*b* are mixed thereto on the basis of the specific gravity and the viscosity to produce a recycled slurry 9. This recycled slurry can be used for MWS.

Herein the dispersion medium after the secondary separation contains about 10% solid (silicon dust, unrecovered abrasive grains, and the like) as shown in FIG. 2(*b*), and the dispersion medium could be purified to 1% or less by the centrifugal force of not less than 5000 G. This enabled that the amount of waste liquid to be disposed is reduced to 10% (conventionally 70%) while silicon dust remaining in a concentration of about 8%.

As for the time for producing a recycled slurry, it takes only 3 hours in contrast to 4 hours required in Example 1, to produce 600 L of recycled slurry when centrifugation at 3500 G is employed prior to centrifugation at 5000 G.

Example 3

Figure 4:
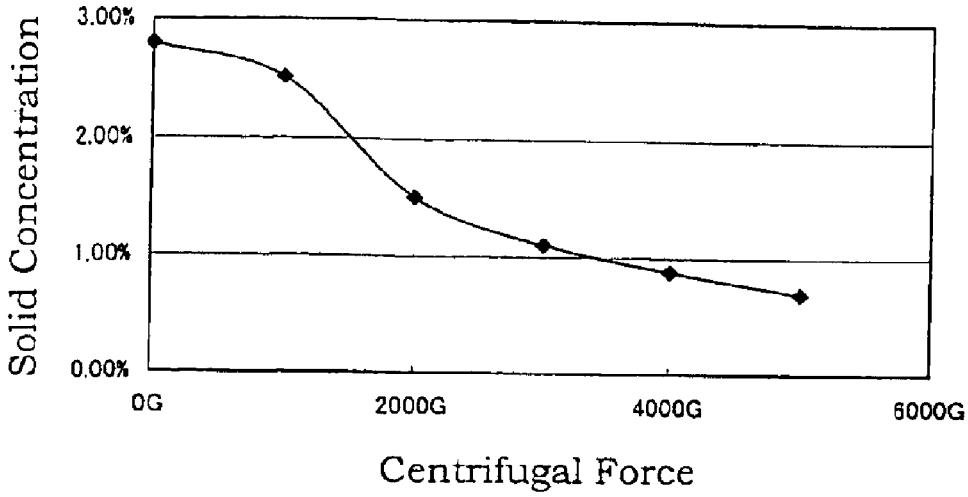
FIG. 4 is a graph showing the relationship between a centrifugal force and a solid concentration.

The method according to Example 3 is similar to the slurry recycling method according to Example 2 except that the centrifugal force is in the range of 2000 to 4000 G for the primary centrifugation, and 5000 G or more for the secondary centrifugal force. This example will be explained using FIG. 4. FIG. 4 is a graph showing the remaining amount of silicon dust when the centrifugal force of the secondary centrifugation is increased from 0 G to 5000 G by 1000 Gs, while keeping the centrifugal force of the tertiary separation at 5000 G. As describe above, it can be found that the removal ratio is significantly decreased when the centrifugal force of the secondary centrifugation is varied within the range of 2000 G to 4000 G, and the time for producing the recycled slurry is decreased.

Example 4

Figure 5:
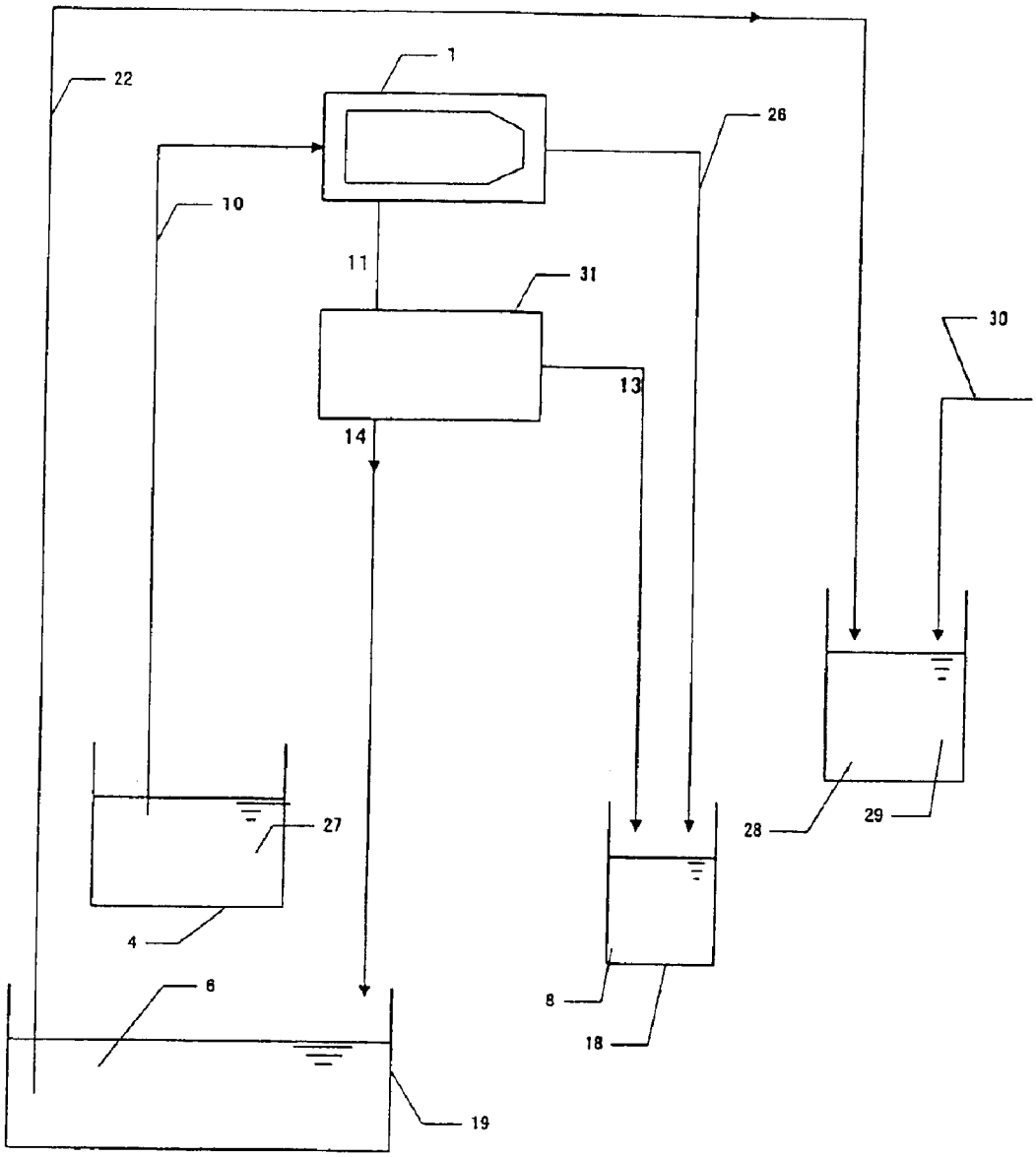
FIG. 5 is a schematic view of an apparatus which can be used for the slurry recycling method of the present invention.

Example 4 is a slurry recycling method characterized by subjecting a spent slurry to centrifugation and subsequent distillation. Example 4 will be explained with reference to FIG. 5. FIG. 5 shows a structure of an apparatus used in Example 4.

The initial slurry contains abrasive grains and a dispersion medium in a ratio of 1:1., one-third of a spent slurry after slicing was drawn out (hereinafter, referred to as "waste slurry 27"), and a corresponding amount of new slurry was introduced. Repeating the above process for several times made the waste slurry 27 a liquid which contains silicon dust, abrasive grains and dispersion medium in the ratio of about 20%: 45%: 36% by weight. The condition for MWS such as ingot mounting and the like is as same as that described in Example 1.

In FIG. 5, the waste slurry 27 is fed into a primary centrifugal separator 1 via a piping 10. The primary centrifugal separator 1 operates at a centrifugal force of 3100 G to separate the slurry into a sludge 8 and a recovered liquid. The recovered liquid is then distilled at a distillation apparatus 31 to obtain a recovered dispersion medium 6. The distillation apparatus is heated to the boiling point +20° C. of the dispersion medium. The recovered dispersion medium 6 is a solid free dispersion medium. Then the recovered dispersion medium 6 is mixed with a new slurry 30 in a recycled slurry tank 29 to be rendered a recycled slurry 28.

Figure 6:
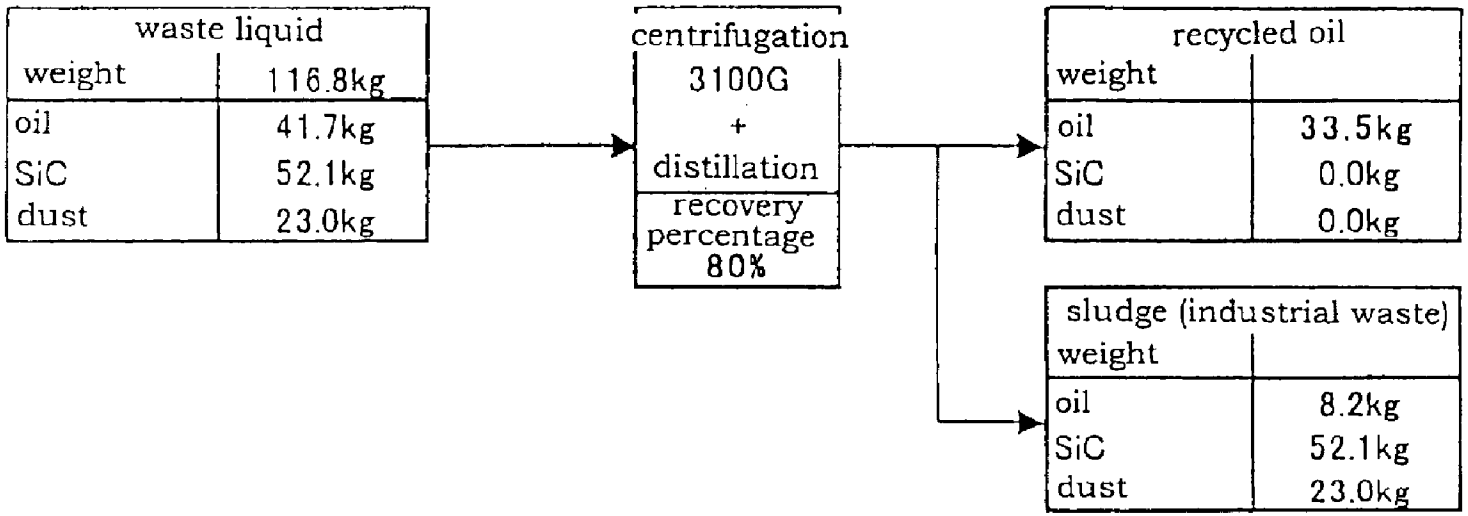
FIG. 6 is a view for explaining a recovery percentage of the slurry recycling method of example 4.

Conditions for recycling are shown in FIG. 6. As can be seen from FIG. 6, 80% of dispersion medium could be recovered from the waste slurry. The merits realized by employing centrifugation in the distillation system are: reduction in distillation time when the facility is the same; reduction in facility cost; and reduction in fuel expense and electricity expense owing to combination of centrifugation and distillation.

Comparing the case where only distillation is conducted by the same facility as that of FIG. 5, and the case where centrifugation and distillation are conducted, it took only 45 minutes to treat 100 kg of waste slurry 27 when centrifugation and distillation are employed, whereas 1 hour was required when only distillation is employed in the distillation system having a throughput of 100 Kg/H.

The facility cost for the same treatment time is about 1.2 to 1.5 times higher in the case where centrifugation and distillation are combined than the case where only distillation is employed. Furthermore, the difference between fuel expense and electricity expense when a dispersion medium having a boiling point of 105° C. is used, is about ¥5 per 1 kg of waste slurry in the case where centrifugation and distillation are combined, and about ¥10 in the case where only distillation is employed.

Figure 7:
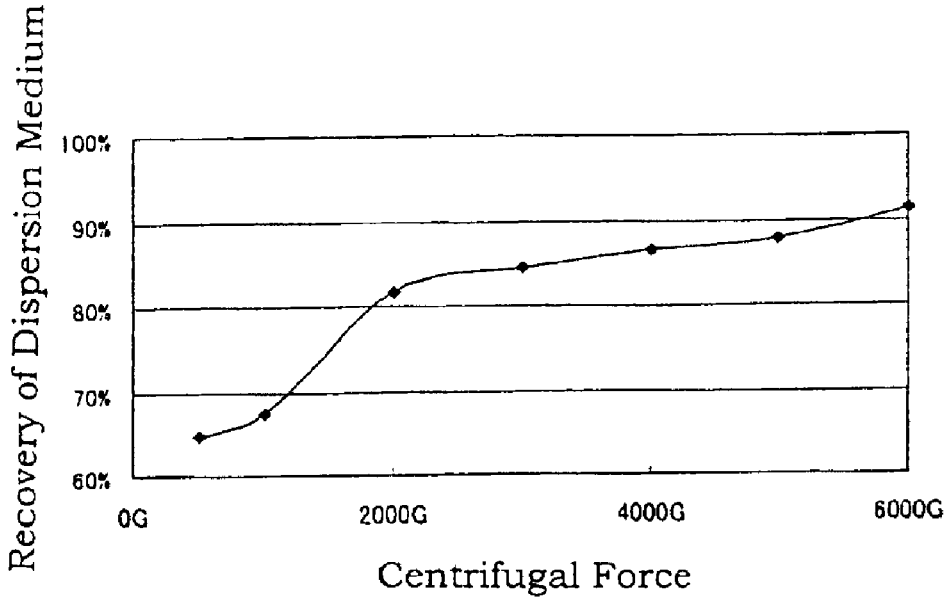
FIG. 7 is a graph showing the relationship between a centrifugal force and a recovery of the dispersion medium.

Furthermore, in this example, when the centrifugal force of the primary centrifugation is 2000 G or more as seen from FIG. 7, the recovery of the dispersion medium can be 80% or more.

Specifically, when the centrifugal force is 3100 G, the spent slurry as shown in Table 1 can be separated as shown in Table 2.

Example 5

Example 5 will be explained with reference to FIG. 3 and FIG. 7. In Example 5, a distillation apparatus 31 is used in place of the separator 25, the piping 15, 16, the waste liquid tank 21 and the tertiary centrifugal separator 3 in FIG. 3. A spent slurry is subjected to centrifugal separation to separate a primary dispersion medium mainly containing usable abrasive grains from the spent slurry. The primary dispersion medium is further centrifuged and a resultant waste dispersion composed of dispersion medium and a waste liquid 7 is distilled to recover the dispersion medium. Consequently, a greater amount of dispersion medium can be recovered. FIG. 7 shows recovery of dispersion medium with respect to centrifugal force when a spent slurry is processed by centrifugation and distillation after slicing, the spent slurry comprising at least silicon dust, abrasive grains, dispersion medium and occurring after supplying a group of wires of MWS with a slurry in which abrasive grains are dispersed in a dispersion medium in order to slice a silicon ingot into wafers.

According to the present invention, the improvement in recovery of dispersion medium reduces the industrial waste, so that production cost of wafers is reduced without impairing the accuracy of the wafers. Furthermore, reduction in industrial waste is also advantageous from the aspect of grovel environment.

What is claimed is:

1. A slurry recycling method comprising the steps of:

separating a spent slurry containing silicon dust resulting from slicing of a silicon ingot in the presence of a slurry comprising abrasive grains and a dispersion medium in which the abrasive grains are dispersed, into a dispersion mainly containing the abrasive grains and a dispersion mainly containing the silicon dust;

recovering the dispersion medium by centrifuging and distilling the dispersion mainly containing the silicon dust; and reproducing a slurry using abrasive grains or the dispersion mainly containing abrasive grains, and the recovered dispersion medium, wherein the recovered dispersion medium comprises water, water-soluble organic solvent(s), and/or oily organic solvent(s).

2. A slurry recycling method of claim 1, wherein the content of the silicon dust in the spent slurry is 12% by weight or more.

3. A slurry recycling method of claim 2, wherein the content of the silicon dust in the spent slurry is 12 to 25% by weight.

4. A slurry recycling method of claim 1, wherein the separation of the spent slurry into the dispersion mainly containing the abrasive grains and the dispersion mainly containing the silicon dust is conducted by centrifugation by a centrifugal force of 200 to 1200 G.

5. A slurry recycling method of claim 1, wherein the centrifugation being carried out by a centrifugal force of 2000 G or more.

6. A slurry recycling method of claim 5, wherein the centrifugal force is in the range of 5000 to 20000 G.

7. A slurry recycling method of claim 1, wherein the recovered dispersion medium contains 4% by weight or less of a solid mainly containing the silicon dust and the abrasive grains.

8. A slurry recycling method comprising the steps of:

providing a spent slurry comprising silicon dust resulting from slicing of a silicon ingot in the presence of a slurry comprising abrasive grains and a dispersion medium in which the abrasive grains are dispersed, separating the spent slurry into a dispersion mainly containing the abrasive grains and a dispersion mainly containing the silicon dust and dispersion medium;

recovering the dispersion medium by distilling the dispersion mainly containing the silicon dust and dispersion medium by heating the dispersion mainly containing the silicon dust and dispersion medium to a temperature at least as high as a boiling point of the dispersion medium in order to obtain a recovered dispersion medium.

wherein the recovered dispersion medium comprises water, water-soluble organic solvent(s), and/or oily organic solvent(s); and reproducing a slurry using abrasive grains or the dispersion mainly containing abrasive grains, and the recovered dispersion medium.

9. A slurry recycling method of claim 8, wherein the content of the silicon dust in the spent slurry is 12% by weight or more.

10. A slurry recycling method of claim 9, wherein the content of the silicon dust in the spent slurry is 12 to 25% by weight.

11. A slurry recycling method of claim 8, wherein the separation of the spent slurry into the dispersion mainly containing the abrasive grains and the dispersion mainly containing the silicon dust and dispersion medium is conducted by centrifugation by a centrifugal force of 200 to 1200 G.

12. A slurry recycling method of claim 8, wherein the recovered dispersion medium contains 4% by weight or less of a solid mainly containing the silicon dust and the abrasive grains.

* * * * *